US006074037A

United States Patent [19]

Nakahara et al.

[11] Patent Number: 6,074,037

[45] Date of Patent: Jun. 13, 2000

[54] PRINT HEAD CAPPING DEVICE

[75] Inventors: Junji Nakahara; Hirotake Nakamura, both of Nagoya, Japan

[73] Assignee: Brother Kogyo Kabushiki Kaisha, Nagoya, Japan

[21] Appl. No.: 08/965,364

[22] Filed: Nov. 6, 1997

[30] Foreign Application Priority Data

| | | | |
|---|---|---|---|
| Nov. 15, 1996 | [JP] | Japan | 8-320814 |
| Jul. 8, 1997 | [JP] | Japan | 9-182833 |

[51] Int. Cl.[7] ..... B41J 2/165

[52] U.S. Cl. ..... 347/29; 347/33

[58] Field of Search ..... 347/29, 33, 30, 347/28

[56] References Cited

U.S. PATENT DOCUMENTS

| | | | |
|---|---|---|---|
| 4,148,041 | 4/1979 | Rosenstock | 347/28 |
| 4,684,963 | 8/1987 | Naka | 347/29 |
| 5,146,243 | 9/1992 | English et al. | 347/29 |
| 5,625,385 | 4/1997 | Suzuki | 347/30 |
| 5,648,802 | 7/1997 | Abe | 347/29 |
| 5,896,143 | 4/1999 | Matsui et al. | 347/30 |

FOREIGN PATENT DOCUMENTS

| | | | |
|---|---|---|---|
| 173939 | 3/1986 | European Pat. Off. | 347/29 |
| 58-168569 | 10/1983 | Japan | B41J 3/04 |
| 61-211046 | 9/1986 | Japan | B41J 3/04 |
| 62-113556 | 5/1987 | Japan | 347/29 |
| 4-173345 | 6/1992 | Japan | B41J 2/175 |
| 4-59145 | 9/1992 | Japan | B41J 2/165 |

*Primary Examiner*—N. Le
*Assistant Examiner*—Shin-Wen Hsieh
*Attorney, Agent, or Firm*—Oliff & Berridge, PLC

[57] ABSTRACT

A cap is provided with a contact section for contacting and enclosing the periphery of a nozzle array of a print head when the print head is in a capped state, and a deforming diaphragm having a deformable bag-shaped section in a position enclosed by the contact section. In the case of a temperature change in an enclosed space between the contact section and the nozzle, the bag-shaped section expands or contracts to keep a constant pressure, thereby protecting a print head meniscus from breakage and accordingly preventing the occurrence of defective printing. Furthermore, the capping device is separate from a recording device, so that it can be attached to a head unit removed from a printer at the time of shipping the head unit from a factory, to thereby prevent the nozzle array from drying out.

17 Claims, 11 Drawing Sheets

PRINT HEAD CAPPING DEVICE

BACKGROUND OF THE INVENTION

1. Field of the Invention

The invention relates to a print head capping device and, more particularly, to a technique for preventing breakage of a print head ink meniscus and for protecting the print head during transport.

2. Description of the Related Art

It is known to cap a print head with a capping device in order to prevent an ink jet nozzle of the print head from drying out. At the time of capping, if the temperature in the space enclosed by the print head and the capping device (hereinafter called the space in the cap) varies, the air in the space in the cap expands or contracts, thereby changing the pressure in the space in the cap.

At the end of the ink in the print head nozzle, a meniscus is formed that has a surface tension. The meniscus is liable to be broken at a very low pressure. If the pressure in the space in the cap increases with a temperature rise, the meniscus may be broken by the expanding air, which then, in the form of air bubbles, enters into the nozzle, and disturbs future ink ejection. Further, if the pressure in the space in the cap decreases with a drop in the temperature, the ink may be drawn into the cap through the nozzle, resulting in ink accumulation inside the cap. Consequently the nozzle surface will be smeared with the ink accumulated within the cap, so that when the ink is jetted, the direction of ink jetting deviates from the intended direction or the ink jetting itself is disturbed. Consequently, either one of a rise or drop in the temperature can result in defective printing.

Therefore, it is necessary to hold the pressure in the space in the cap to a low pressure at which the meniscus will not be broken. As techniques for so holding the pressure in the space in the cap, there are, as has been disclosed in the U.S. Pat. No. 4,684,963, (1) a capping device provided with a damper chamber connected to the cap section to absorb a pressure change in the space in the cap, and (2) a capping device in which the space in the cap is communicated with the outer atmosphere in order to prevent the occurrence of a pressure change.

During transport as well as shipping of a print head or a head unit from the point of manufacture, a preservation liquid having the same properties as the ink, exclusive of dyes and pigments, is placed in a print head, i.e., in each ink chamber formed in an actuator, and a manifold connected with each ink chamber for the purpose of smooth initial ink introduction at the time of the beginning of use. Further, to prevent leakage of the preservation liquid and to protect the nozzle from damage, the nozzle plate is capped with a protecting rubber or the like to keep the ink chamber and manifold interior hermetically sealed.

The above-described capping device (1), however, has drawback that other parts, such as a damper chamber, than the capping device must be attached to the capping device, making the device complicated in structure and accordingly large in size. In the capping device (2), since the space in the cap communicates with the atmosphere, the nozzle is likely to dry out. Also, in a conventional damper chamber, only walls constituting the damper chamber are partly made of a thin film and displaced to absorb a pressure change in the space in the cap, and therefore the space in the cap displaces little, resulting in a relatively low pressure holding effect for the capacity occupied by the damper chamber.

When the nozzle plate of the print head is capped with the protecting rubber or the like at the time of shipping, a pressure difference between the interior of the print head and the outside increases with an external pressure change and an internal pressure rise caused by the evaporation of the preservation liquid in the ink chambers and the manifold. As a result, the print head interior will communicate with the outer atmosphere through the lip section of the protecting rubber or the like, resulting in a dry nozzle.

SUMMARY OF THE INVENTION

In view of the above-described disadvantages, it is an object of the invention to provide a print head capping device of simple structure which is capable of absorbing a pressure change in the space within the cap and keeping the nozzle fully enclosed to prevent the nozzle from becoming dry.

To accomplish the above-described object, the print head capping device according to a first aspect of the invention has a capping section for enclosing a nozzle when the print head for jetting ink from the nozzle for a recording operation is not in operation, and is provided with a contact section which contacts a surrounding portion of the nozzle and a deforming section having an opening portion which opens towards the nozzle, the deforming section changing a shape of the opening portion to change a size of an enclosed space between the capping device and the nozzle when the contact section is in a contact state with the nozzle.

In the above-described structure, since the size of the space defined between the nozzle and the capping device is changed in the position where the deforming section is enclosed with the contact section, the deforming section absorbs a pressure change when the temperature in the enclosed space formed by capping varies, thereby constantly keeping a fixed pressure within the space. The entire part of the deforming section deforms to allow a change in the capacity of the enclosed space, and therefore the print head is usable even in the case of a relatively large pressure change. The pressure in the enclosed space, therefore, is constantly kept lower than the meniscus breaking pressure of the print head to thereby prevent defective printing. Also since a constant pressure is kept without connecting the space in the cap with the atmosphere, it is possible to prevent the nozzle and ink from drying out.

Furthermore, the print head capping device according to a second aspect of the invention is the print head capping device according to the first aspect, in which the deforming section can deform so that the pressure in the enclosed space at the time of capping will be lower than the meniscus breaking pressure of the print head.

In the structure stated above, since the deforming section can deform so that the pressure in the enclosed space at the time of capping will be lower than the meniscus breaking pressure of the print head, it is possible to prevent, by a simplified structure, defective printing likely to be caused by the breakage of the meniscus. Furthermore, since a constant pressure is kept without connecting the space in the cap with the outer atmosphere, it is possible to fully prevent the nozzle and ink from drying out.

Furthermore, the print head capping device according to a third aspect of the invention is the print head capping device according to the first aspect or the second aspect, in which the deforming section is provided with a bag-shaped section having a side wall extending in a direction away from the nozzle.

In the above-described structure, the deforming section is a bag-shaped part having a side wall open to the nozzle side and extended in a direction away from the nozzle; therefore the deforming section, particularly the side wall, is likely to deform, easily responding to even a slight pressure change to thereby further prevent defective printing in the event of a change in the enclosed space temperature.

The print head capping device according to a fourth aspect of the invention is the print head capping device according to the third aspect, in which the deforming section has a flange section for connecting a periphery of the opening portion of the bag-shaped section to the contact section.

In the above-described structure, the bag-shaped section can be disposed in a position directly facing the nozzle of the print head, with the result that the bag-shaped section can be made larger in size to easily absorb even a great pressure change. With the deformation of the bag-shaped section, the flange also deforms, thereby enabling an improved response to a pressure change.

The print head capping device according to a fifth aspect of the invention is the print head capping device according to the third aspect, in which the bag-shaped section has, in a cross section which is in parallel with the contact section, a greater profile length than a minimum profile length which can surround an inside area of the bag-shaped section.

In the above-described structure, because the bag-shaped section has a longer contour length than a minimum profile length that is capable of surrounding an inside area of the bag-shaped section, such as a circular outer periphery, it is possible to decrease contraction or expansion, to absorb a pressure change by deformation. That is, a force required for bending or deforming the wall of the bag may be little as compared with a force against the contraction or expansion, i.e., the elasticity along the direction of the bag wall, thus achieving improved response to a pressure change. Furthermore, since the elasticity acting to restore the original shape can be reduced, it is possible to obviate such a drawback as increases or decreases of the pressure in the enclosed space.

The print head capping device according to a sixth aspect of the invention is the print head capping device according to the third aspect, in which the bag-shaped section, in a cross section which is in parallel with the contact section, has a flat and long shape corresponding to the longitudinal direction of a row of a plurality of nozzles.

In the above-described structure, the invention stated in the sixth aspect can make the bag-shaped section in an easy-to-form flat form. Since the bag-shaped section is aligned with the longitudinal direction of the row of nozzles, the side wall in the direction of flatness of the bag-shaped section can be made substantially large, allowing easy deformation with a pressure change.

Furthermore, the print head capping device according to a seventh aspect of the invention is the print head capping device according to the third aspect, in which at least a part of the wall of the bag-shaped section can move inwardly and outwardly of the bag-shaped section its on one end of the side wall as a support point to change the size of the enclosed space between the capping device and the nozzle.

In the above-described structure, since at least a part of the wall of the bag-shaped section can move inwardly and outwardly of the bag-shaped section on one end of the side wall as a support point, the bag largely deforms almost without contracting the wall. That is, the bag-shaped section can respond to even a slight pressure change almost without resisting the elasticity along the direction of the wall. Besides, because only a little elasticity is required to recover the original shape, there will be little occurrence of the problem that the pressure in the enclosed space is increased or decreased.

Furthermore, the print head capping device according to an eighth aspect of the invention is the print head capping device according to the seventh aspect, in which the bag-shaped section has a narrow space nearly at the center of a pair of side walls and a wide space at both ends of the pair of side walls.

In the above-described structure, the invention of the seventh aspect can make the bag-shaped section in an easy-to-form shape. Also, since the bag-shaped section has a narrow space nearly at the center of a pair of side walls and a wide space at both ends of the pair of side walls, the bag-shaped section makes a quick change in shape within a wide range with a pressure change, acting properly and broadly from a small pressure change to a large pressure change.

Furthermore, the print head capping device according to a ninth aspect of the invention is the print head capping device according to the third aspect, in which the side walls of the bag-shaped section have a bellows structure.

In the above-described structure, the side walls of the bag-shaped section of the deforming section, having the bellows structure, can absorb a wide range of pressure changes regardless of positive and negative pressures.

Furthermore, the print head capping device according to a tenth aspect of the invention is the print head capping device installed to the head unit to enclose each nozzle for the purpose of protecting the nozzle of each print head of the head unit provided with a plurality of print heads, and has a connecting member for connecting the head unit to the capping device, and a cap member comprised of an elastic member and provided for each of the plurality of print heads on the connecting member, the cap member tightly contacting a periphery of each nozzle with a constant pressure.

In the above-described structure, the connecting member is connected to the head unit to thereby cover each nozzle of the plurality of print heads with a cap member. Therefore, for instance at the time of shipping of the head unit from a manufacturing factory, the nozzle of each print head of the head unit is kept enclosed to thereby protect the nozzle from exposure to the outer atmosphere, thus preventing the nozzle from drying out. Also, since the capping device can be mounted to cover all the nozzles of the plurality of print heads by a single mounting operation, the device of the invention is convenient to use. In addition it is possible to cap all the nozzles of the plurality of print heads with an equal pressure. Furthermore, because the nozzles can be capped all uniformly, all the nozzles of the plurality of print heads can be tightly closed.

Furthermore, the print head capping device according to an eleventh aspect of the invention is the print head capping device of the tenth aspect, in which the cap member is provided integrally with a contact section hermetically attached to the periphery of the nozzle, and a deforming section for forming a deforming space in a position enclosed by the contact section thereby absorbing a pressure change in the enclosed space when the print head is capped.

In the above-described structure, with the absorption of a pressure change in the enclosed space by the deflection of the deforming section, a pressure difference from the outside is absorbed, thereby reliably preventing exposure of the nozzles to the atmosphere and to reliably hold the print head nozzles in a closed state and prevent them from drying out.

Furthermore, the print head capping device according to a twelfth aspect of the invention is the print head capping device of the eleventh aspect, in which the print head is filled with a preservative liquid.

In the print head filled with the preservative liquid at the time of shipment, or during transport, of the print head of the above structure in order to insure smooth initial introduction of the ink at the beginning of use, mounting the capping device of the twelfth aspect can be preferably accomplished to protect the nozzle from drying by preventing exposure of the enclosed space to the atmosphere in the event of an external or internal pressure change.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Figure 1:
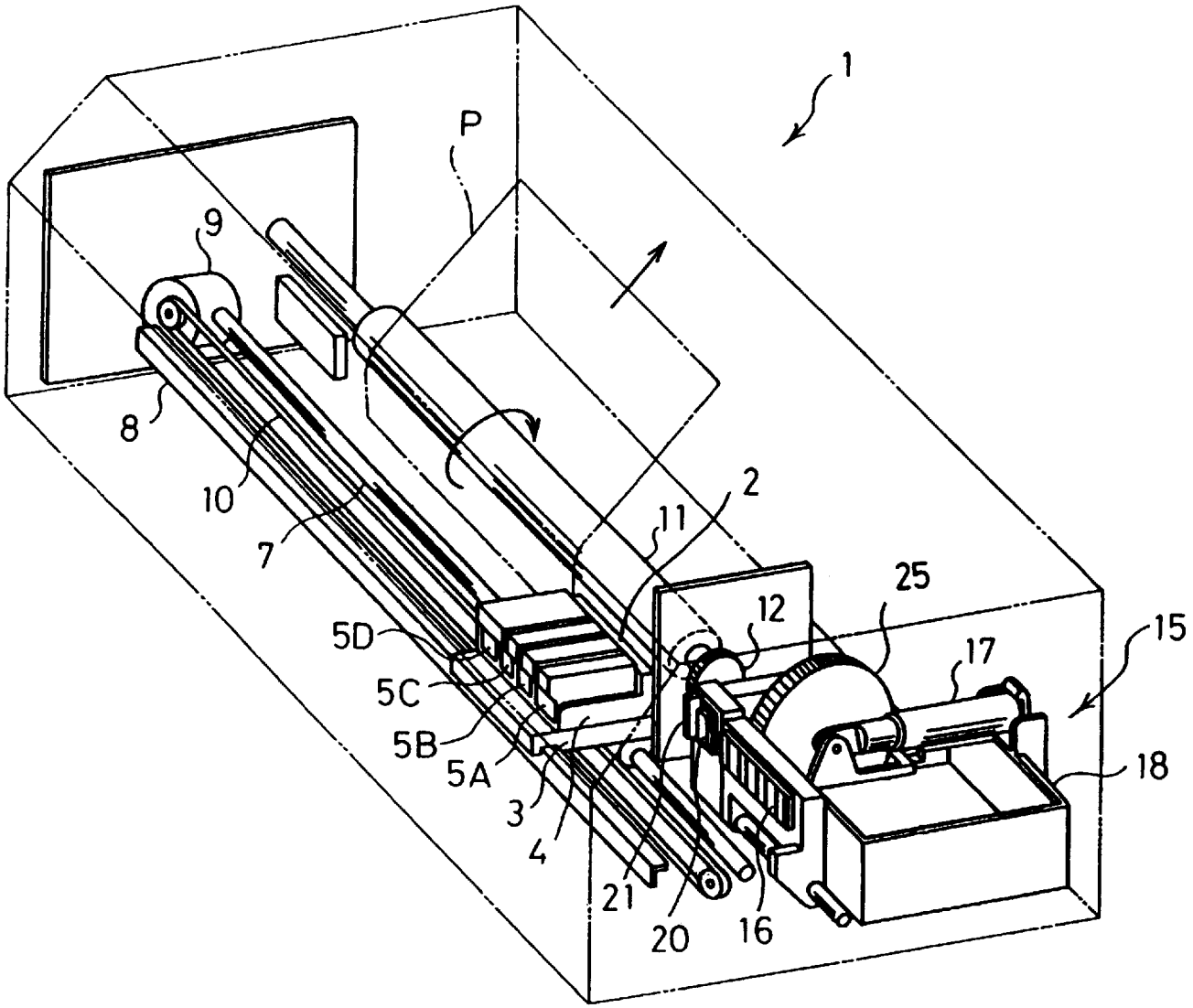
FIG. 1 is a perspective view showing a printer provided with a print head capping device.

A color ink jet printer provided with a print head capping device will hereinafter be described with reference to the accompanying drawings. FIG. 1 is a perspective view showing the printer. The color ink jet printer (hereinafter called the printer) 1 has four ink jet print heads 2, each of which jets ink of one of four colors (cyan, magenta, yellow, and black) onto a recording medium P, such as a printing paper. Each of the print heads 2 has, at the forward end surface (nozzle surface) 2A (FIGS. 7A, 7B and 13) thereof, a plurality of nozzles open to jet the ink, and is supported on a carriage 3 which is driven to linearly reciprocate at the time of printing.

The four print heads 2 are integrally mounted with a head holder 4, thus forming one head unit. Ink cartridges 5A, 5B, 5C, 5D are removably mounted on the carriage 3 to supply the ink of the appropriate color of the four colors to each one of the print heads 2. The carriage 3 is supported at the front portion on a carriage shaft 7, so that it can slide along the carriage shaft 7. The rear portion of the carriage 3 is slidably supported on a guide plate 8 (directions are relative to the print heads 2 with the nozzles at a front, i.e., toward platen roller 11). The carriage 3 is driven to reciprocate by a carriage motor 9 through a belt 10.

Opposing the print head 2 is the platen roller 11. The platen roller 11 is driven by the driving power transmitted from a line feed motor through a platen gear 12. The recording medium P is conveyed by the platen roller 11 to a position facing the print head 2 where printing is carried out. Mounted adjacent one end of the platen roller 11 is a purging device 15. The purging device 15 serves to recover a good ink jetting condition by eliminating defective ink jetting during use resulting from the occurrence of air bubbles inside the print head 2 or by the attachment of droplets of the ink on the nozzle surface 2A. Furthermore, the purging device 15 is also driven when the print head 2 or any of the ink cartridges 5A–5D is replaced, functioning to smoothly supply the ink from inside the replaced ink cartridge 5A–5D to the nozzles of the corresponding print head 2.

The purging device 15 has an absorbing cap 20 which selectively attaches to a nozzle surface 2A of each print head 2. The purging device 15 functions to draw air bubbles and defective ink from inside the print head 2 through the nozzle to restore the print head 2 by the use of a negative pressure built up in a pump 17 when the absorbing cap 20 is attached tightly to the nozzle surface 2A. The defective ink thus drawn from the print head 2 is sent to a reservoir section 18. On the side of the absorbing cap 20 is a wiper 21 provided to wipe the nozzle surface 2A of the print head 2.

Figure 3:
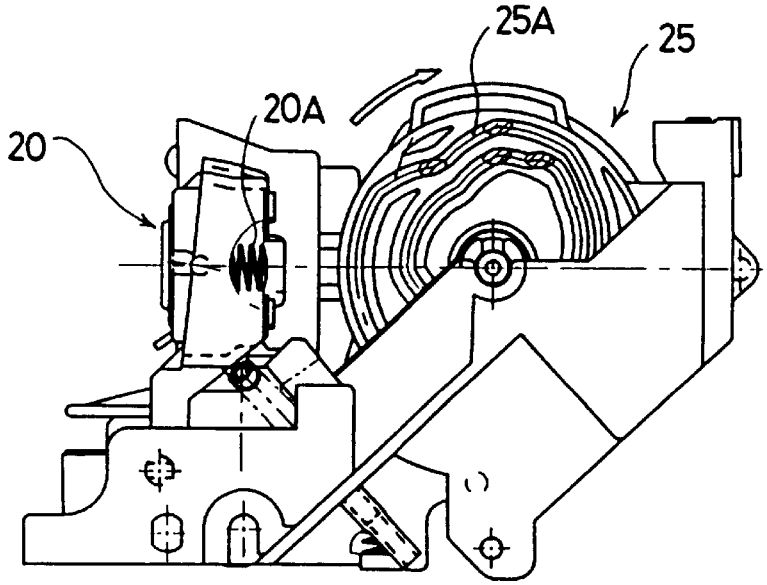
FIG. 3 is a side view showing the absorbing cap and wiper driving mechanism of the first embodiment.

A driving mechanism for driving the absorbing cap 20 and other portions will be explained with reference to FIG. 3. FIG. 3 is a side view showing the driving mechanism for driving the absorbing cap 20 and other elements. The purging device 15 is driven by the driving power transmitted from the line feed motor (not shown) through a pump cam gear 25. The pump cam gear 25 has a cam groove 25A for moving the absorbing cap 20 in the direction of the print head 2. The absorbing cap 20 is provided with an engaging section for moving the absorbing cap 20 along the profile of the cam groove 25A while sliding on the cam groove 25A. The absorbing cap 20 is also fitted with a spring 20A for maintaining a constant capping pressure of the absorbing cap 20 to be applied to the print head 2. The pump 17 also is driven by the rotation of the pump cam gear 25. The pump cam gear 25 is also used to move the wiper 21 (see FIG. 1) and other elements. The structure and operation of such a driving mechanism for a purging device and a wiping device is described in U.S. patent application Ser. No. 08/747,387 allowed Jun. 3, 1999, the disclosure of which is incorporated by reference herein.

Figure 2:
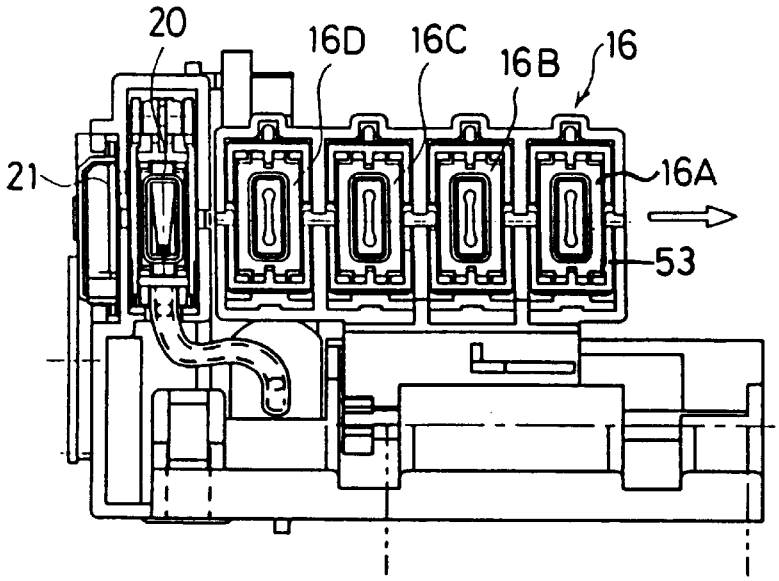
FIG. 2 is a front view showing the capping device and an absorbing cap section of a first embodiment.

In addition to the purging device 15, and adjacent thereto, a capping device 16 is provided for protecting the print head 2. FIG. 2 is a front view showing the capping device 16 and the absorbing cap 20 section. The capping device 16 has four caps 16A, 16B, 16C, 16D for capping the respective nozzle surfaces 2A of the four print heads. The capping device 16 is so designed as to be moved, by means of known cam means, toward contacting the nozzle surfaces 2A of the print head 2, when the carriage 3 has moved as far as the capping position. Thus, the nozzle section is tightly closed to prevent the nozzles and ink from drying out.

Figure 4:
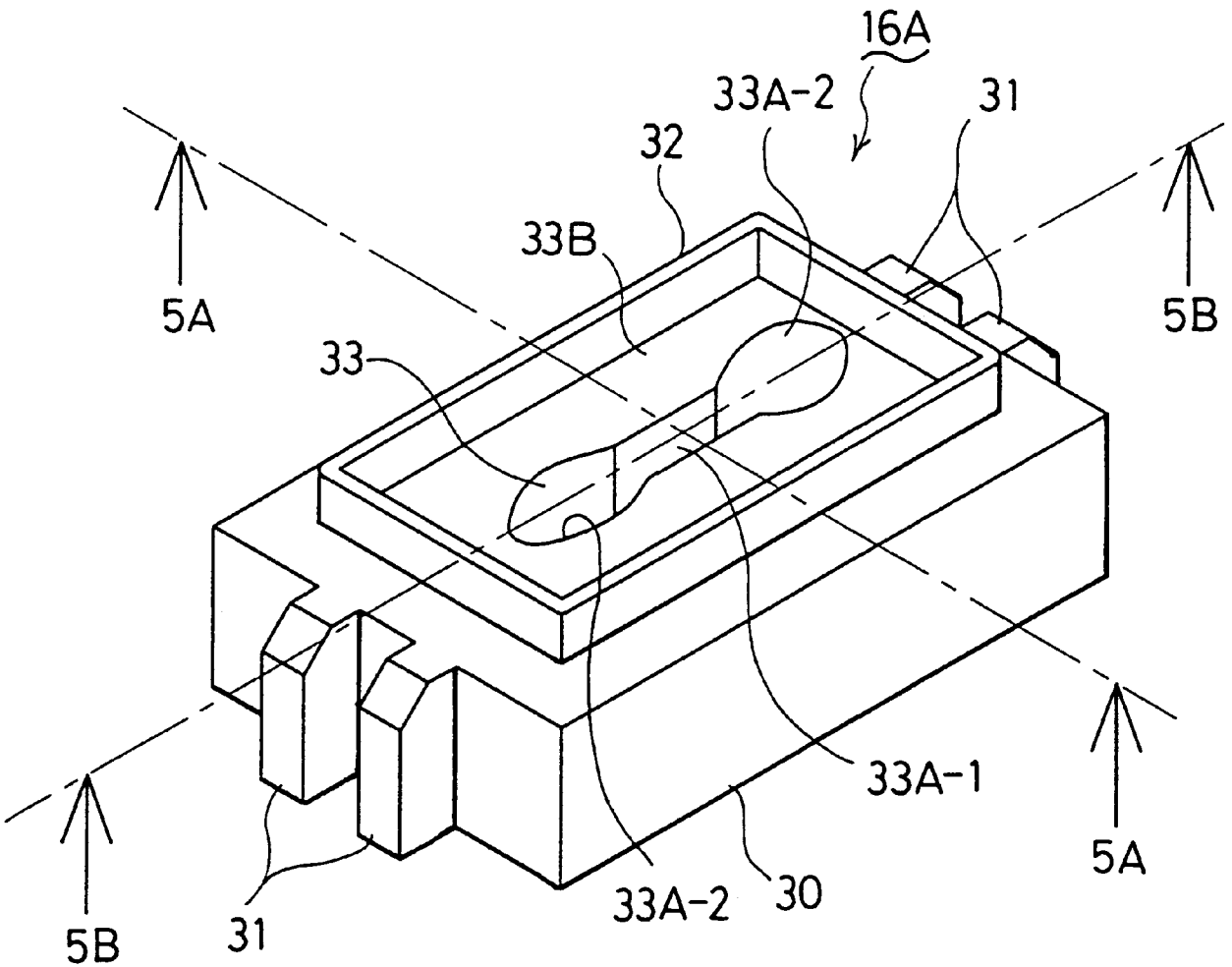
FIG. 4 is a perspective view showing a cap used in the capping device of the first embodiment.
Figure 5A:
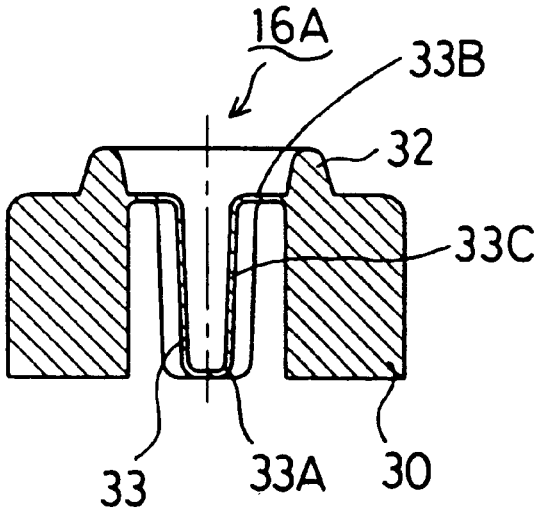
FIG. 5A is a sectional view taken along line 5A—5A of FIG. 4.
Figure 5B:
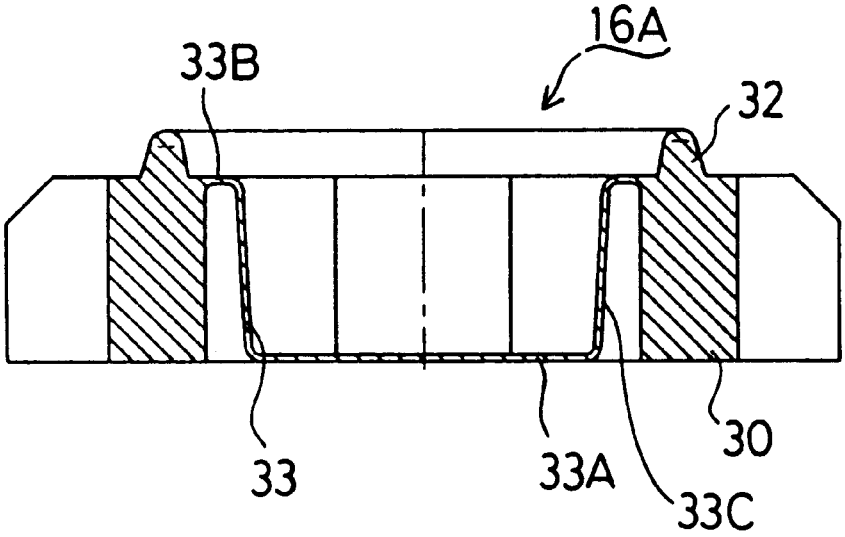
FIG. 5B is a sectional view taken along line 5B—5B of FIG. 4.

The caps 16A–16D of the capping device 16 are of the same structure and, therefore, only cap 16A, as the exemplary cap, will be described with reference to FIGS. 4 to 6A. FIG. 4 is a perspective view showing the cap 16A; FIG. 5A is a sectional view taken along line 5A—5A of FIG. 4; FIG. 5B is a sectional view taken along line 5B—5B of FIG. 4; and FIG. 6A is a view showing the opening portion 133 of a bag-shaped section 33A of the cap 16A.

The cap 16A is made of an elastic material, such as butyl rubber. On the base 30 of the cap 16A are formed a projecting portion 31 for positioning the cap 16A during attachment to a corresponding frame 53 of the capping mechanism, and a rib-shaped projecting contact section 32 for enclosing the nozzles of the print head 2 when in contact with the nozzle surface 2A. Surrounded by the contact section 32 is the deforming diaphragm 33 (deforming section).

The deforming diaphragm 33, shown in FIGS. 4, 5A and 5B, includes a bag-shaped section 33A and a flange 33B surrounding the opening of the bag-shaped section 33A. The deforming diaphragm 33 is formed integrally with the base 30 of the cap. In the bag-shaped section 33A, the opening portion is disposed opposite to the row of nozzles of the print head 2. The side wall 33C extends in a direction away from the print head 2. The flange 33B is enclosed by the contact section 32, with the outer edge of the flange 33B connected to the contact section 32. The bag-shaped section 33A and the flange 33B are both substantially thinner than the base 30 and the contact section 32 so that they can easily deform. The opening portion 133 of the bag-shaped section 33A is formed in a long and nearly flat shape in the longitudinal direction of the row of a plurality of nozzles in a section parallel with the contact section 32.

Figure 6A:
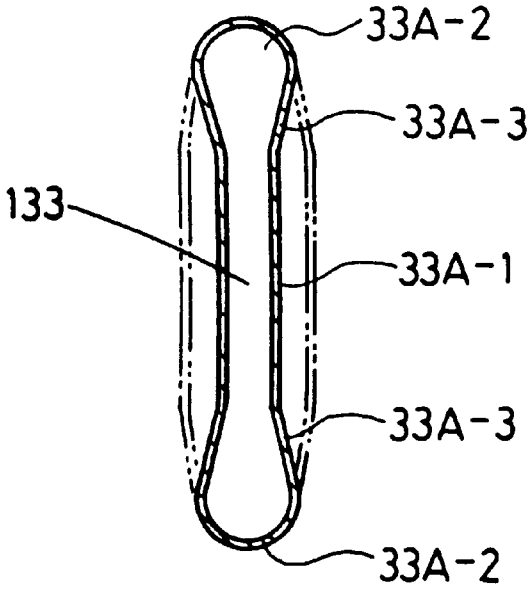
FIG. 6A is a view showing the opening portion of a bag-shaped section of the cap.

The opening portion 133 of the bag-shaped section 33A, as shown in FIGS. 4 and 6A, is so formed to have a parallel sided central portion 33A-1 of the opposing sides of side wall 33C. Both ends 33A-2 are formed in an approximately circular shape having a larger diameter than the width of the central portion 33A-1. Furthermore, the opening portion 133 of the bag-shaped section 33A is of such a shape that the straight central portion 33A-1 and the circular portions 33A-2 are connected by inclined portions 33A-3. The circular portion 33A-2 and inclined portions 33A-3, at both ends of central portion 33A-1, have a resultant tear-drop shape. Thus, the interior space of the bag-shaped section 33A, as described above, is contracted at the center and expanded at both ends. Thus, the straight central portion 33A-1, of the extended wall 33C, can deform, moving inwardly and outwardly, as indicated by a full line and a two-dotted chain line of FIG. 6A.

Figure 7B:
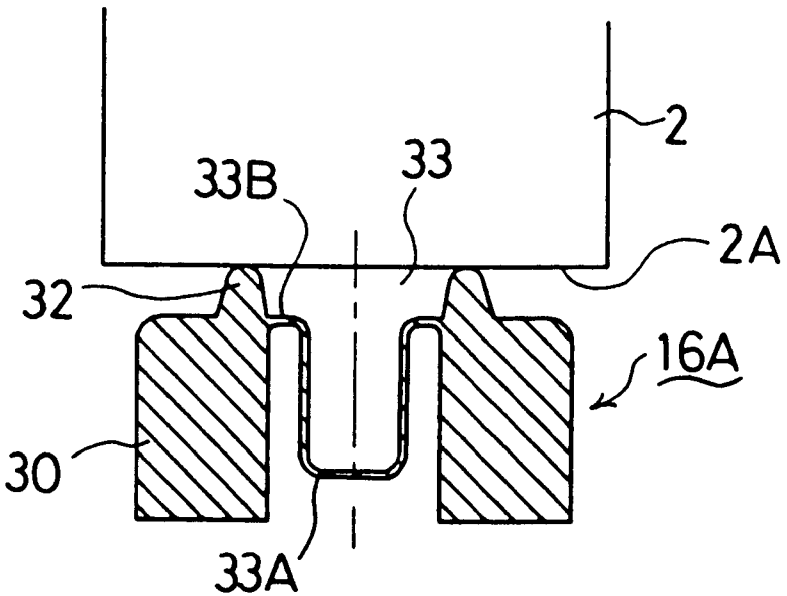
FIG. 7B is a sectional view showing the state of a deforming diaphragm in the case of a temperature rise in the enclosed space between a contact section and a nozzle.
Figure 7A:
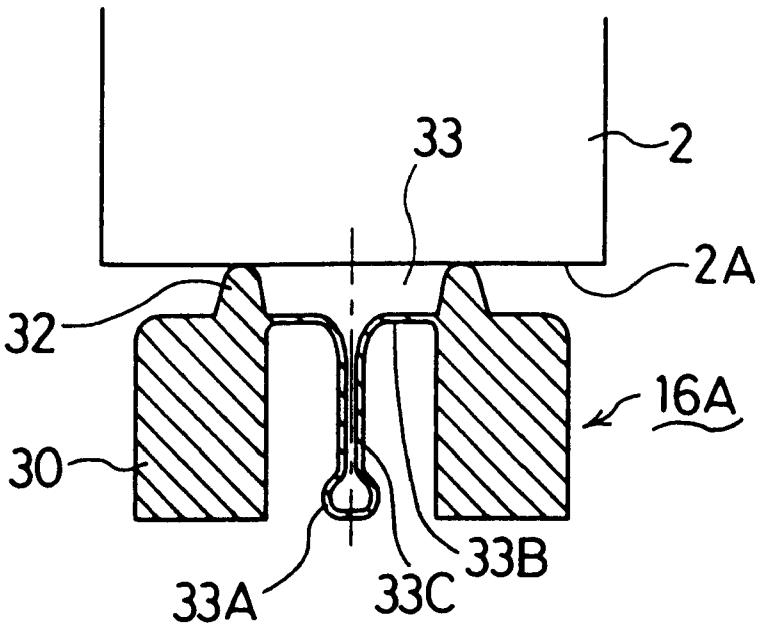
FIG. 7A is a sectional view showing the state of a deforming diaphragm in the case of a temperature drop in a enclosed space between a contact section and a nozzle.

Referring to FIGS. 6A, 7A and 7B, the deformation of the deforming diaphragm 33 will be explained. FIG. 7A is a sectional view showing the state of the deforming diaphragm 33 in case of a temperature drop in the enclosed space between the contact section 32 and the nozzle surface 2A; and FIG. 7B is a sectional view showing the state of the deforming diaphragm in case of a temperature rise in the same enclosed space. If the temperature in the enclosed space between the contact section 32 and the nozzle surface 2A varies, the air in the space expands or contracts. The deforming diaphragm 33 deforms in accordance with the expansion and contraction of the air in the space, thereby maintaining a constant pressure within the space 33. Thus, when the temperature in the enclosed space 33 drops, the volume of the air in the space 33 decreases, and therefore, as shown in FIG. 7A, the bag-shaped section 33A becomes deflated. Contrarily, when the temperature in the enclosed space 33 rises, the space required by the increased volume of air increases and accordingly the bag-shaped section 33A is inflated as indicated by a two-dotted chain line in FIG. 6A and as shown in FIG. 7B.

According to the capping device 16 of the first embodiment, when the temperature in the enclosed space 30 changes, the opening portion 133 of the bag-shaped section 33A will also change due to the change in air volume. With the deformation, the wall 33C of the bag-shaped section 33A also moves inwardly or outwardly, thereby decreasing or increasing the inner volume of the bag-shaped section 33A. Thus decreasing or increasing, particularly increasing, the inner volume of the bag-shaped section 33A absorbs an air pressure change in the enclosed space 30 caused by a temperature change to maintain a constant pressure in the space. Without such an increase in volume, it is likely air will be caused to enter the nozzle as the area of expansion with the least resistance.

Therefore, the pressure in the enclosed space 30 is constantly kept lower than the surface tension of the ink surface, that is, the meniscus, at the top end of the nozzle of the print head. Therefore, there will never take place the problem, caused by a pressure increase, that the meniscus is broken to produce air bubbles, which will go into the nozzle, disturbing the future jetting of the ink. Also, there will also never take place the problem, caused by a pressure decrease, that ink will be drawn from the nozzle into the cap, resulting in ink accumulation in the cap. Furthermore, therefore, the nozzle surface 2A will not become wet with the ink accumulated in the cap, and accordingly the ink, when jetted from the nozzle, will not be caused to swerve or otherwise disturbed, thus achieving a good printing result. Also, since the space in the cap does not communicate with the air, a constant pressure can be maintained, thereby effectively preventing the nozzles and ink from drying out.

It is to be noted that the invention is not limited to the just described first embodiment and various modifications are possible. For example, in the aforementioned embodiment, the cap 16A is produced of butyl rubber, but the material of the cap 16A is not limited to butyl rubber. That is, the cap 16A may be produced of any material so long as the deforming diaphragm 33 is deformable so as to be able to absorb a pressure change in the enclosed space when the print head 2 is capped. However, when the deforming diaphragm 33 itself is expanded or contracted to absorb a pressure change in the enclosed space 30 when the print head 2 is capped, the pressure in the enclosed space will be increased or decreased by the amount of force (restoring force) which is produced when the deforming diaphragm 33 has been expanded or contracted, acting to restore the original shape of the deforming diaphragm 33. In this case, therefore, it is advisable to use a material having a small restoring force.

It is, however, preferable to set, as in the first embodiment, the deforming diaphragm 33 so as to increase or decrease the volume of the enclosed space 30 formed by the deforming diaphragm 33, such that the material of the diaphragm 33 neither expands or contracts itself. To achieve this purpose, however, the bag-shaped section 33A must be designed to have a longer profile length than the minimum profile length. Specifically, the opening portion 133 of the bag-shaped section 33A (the solid lines of FIG. 6B) has a longer profile than the minimum length outer periphery indicated by a dotted line in FIG. 6B. Therefore, it is possible to change the inner volume of the bag-shaped section 33A by deforming the wall 33C of the bag-shaped section 33A outwardly, that is, by deforming the opening portion 133 of the bag-shaped section 33A (as shown by the two-dot lines of FIG. 6A), but without any substantial or measurably significant, expansion or contraction of the material of the bag-shaped section 33A, i.e., without worrying about the elasticity of the bag-shaped section.

Figure 6B:
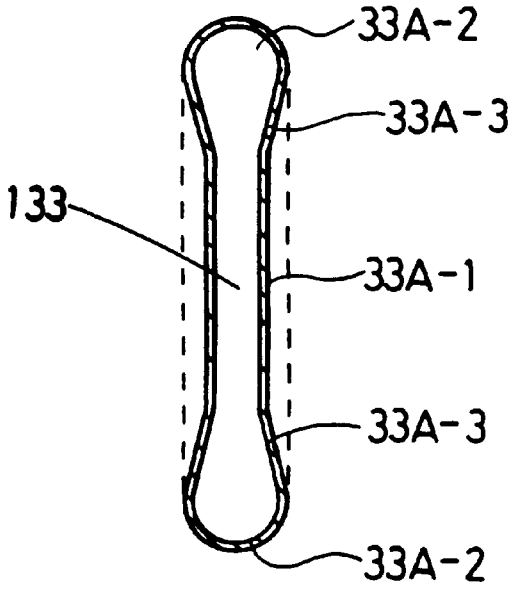
FIG. 6B is a view showing the opening portion of the bag-shaped section of the cap.

Unlike the described embodiment, when the opening portion 133 of the bag-shaped section 33A has a shape as shown by the dashed line of FIG. 6B, and the base of bag-shaped section 33A is semispherical or has a depth with a semispherical forward end, the opening portion 133 of the bag-shaped section 33A cannot deform as in the embodiment. In such a case, the bag-shaped section 33A must expand against the elasticity of the material of the diaphragm 33 so that the pressure in the enclosed space will increase above the meniscus breaking pressure because of the need to overcome the elasticity pressure resistance of the diaphragm material. Thus, for the deforming diaphragm 33 of the bag-shaped section 33A, it is necessary to select a very flexible material. Even so, to obtain the expansion of the bag-shaped section 33A against its own elasticity, a relatively great force is needed.

When the opening portion 133 of the bag-shaped section 33A of the embodiment of the invention is deformed to move the wall 33C of the straight central portion 33A-1 of the bag-shaped section 33A either outwardly (from the solid line position in FIG. 6A) or inwardly (from the two-dot line position of FIG. 6A) little pressure change is needed as compared with the pressure required for contracting and expanding the entire body of the bag-shaped section 33A against the elasticity, thereby improving responsivity to a pressure change. Furthermore, since the structure of the bag-shaped section 33A allows for widening the space in the bag-shaped section 33A by deforming the opening portion 133 and contracting by returning to the formed shape of the bag-shaped section 33A, the pressure in the enclosed space reflects the effects of temperature change and will be neither increased nor decreased by having to overcome the elasticity resistance of the material from which the deforming diaphragm 33 is made.

The shape described above can easily be produced, as shown in the first embodiment, by narrowing the bag-shaped section 33A with the opening portion 133 extending in a direction of arrangement of nozzle holes and further with the wall 33C, on either side of the nozzle holes, extending substantially parallel in the straight central portion 33A-1. By thus adopting this shape, it is possible to provide the side wall 33C with a substantially large, flat surface area in the bag-shaped section 33A; therefore the side wall 33C can easily change its shape in accordance with a pressure change. Also, the bag-shaped section 33A, having a simple configuration, can be integrally molded with the base 30 by the use of a die.

Furthermore, the straight central portion 33A-1 of the bag-shaped section 33A is designed to move inwardly and outwardly as shown in FIG. 6A. Therefore, the wall 33C of the straight central portion 33A-1 and the inclined sides 33A-3 hardly contract or expand when changing position, and the inner volume of the bag-shaped section 33A can make a substantial change despite the material of both the face and back sides at the support point making a slight bend. That is, the bag-shaped section 33A can respond to even a slight change in the normal and negative pressures with little resistance due to elasticity along the direction of the wall 33C. The bag-shaped section 33A of this embodiment, being molded by use of a die which can be split into front and rear halves, can easily be produced.

Figure 8C:
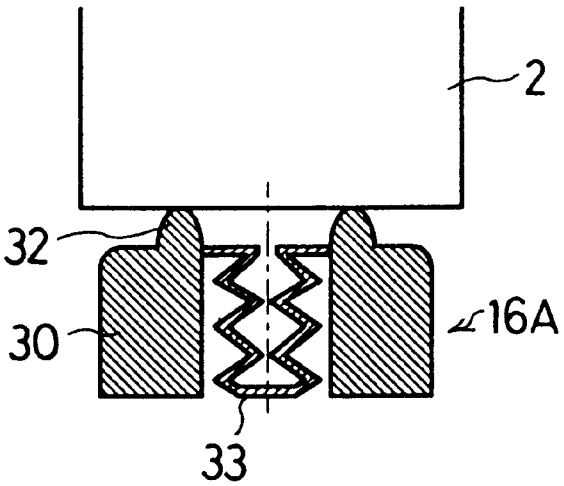
FIG. 8C is a sectional view showing the state of the deforming diaphragm in the case of a temperature rise of the cap of the modified example.
Figure 8B:
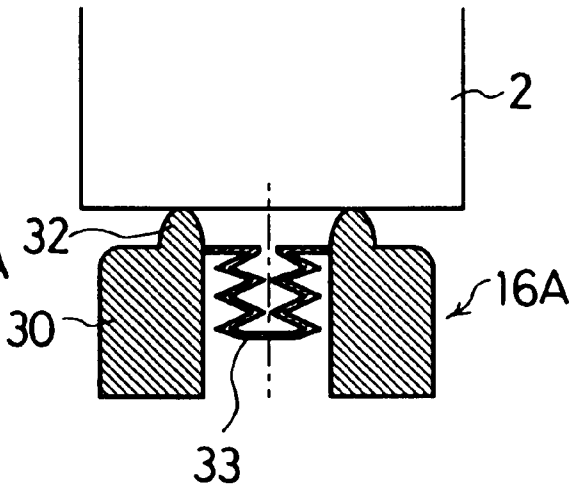
FIG. 8B is a sectional view showing the state of the deforming diaphragm in the case of a temperature drop in the enclosed space between the contact section of the cap of the modified example and the nozzle.
Figure 8A:
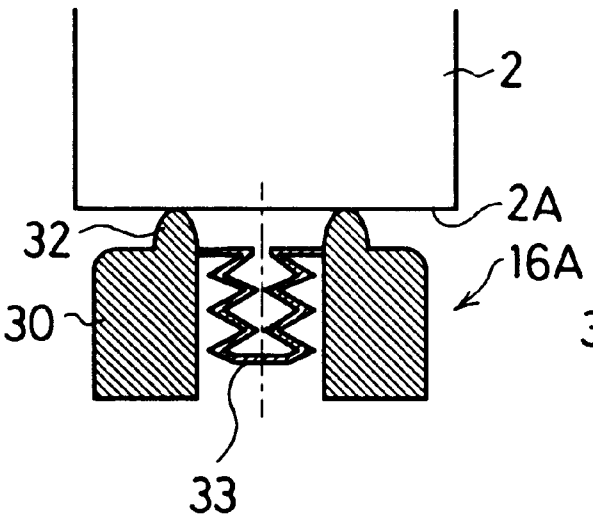
FIG. 8A is a sectional view showing the state of the deforming diaphragm when a cap of a modified example is in an ordinary state.

The deforming diaphragm 33 can be formed not only in the above-described configuration but in various other configurations. For example, the flange 33B is not deformable through the entire surface, and a part near the contact section 32 may be a rigid member. Furthermore, as shown in FIGS. 8A, 8B, 8C, the bag-shaped section 33A may be formed having a bellows structure contractible in a direction in which the bag-shaped section 33A moves towards, and away from, the print head.

Figure 9:
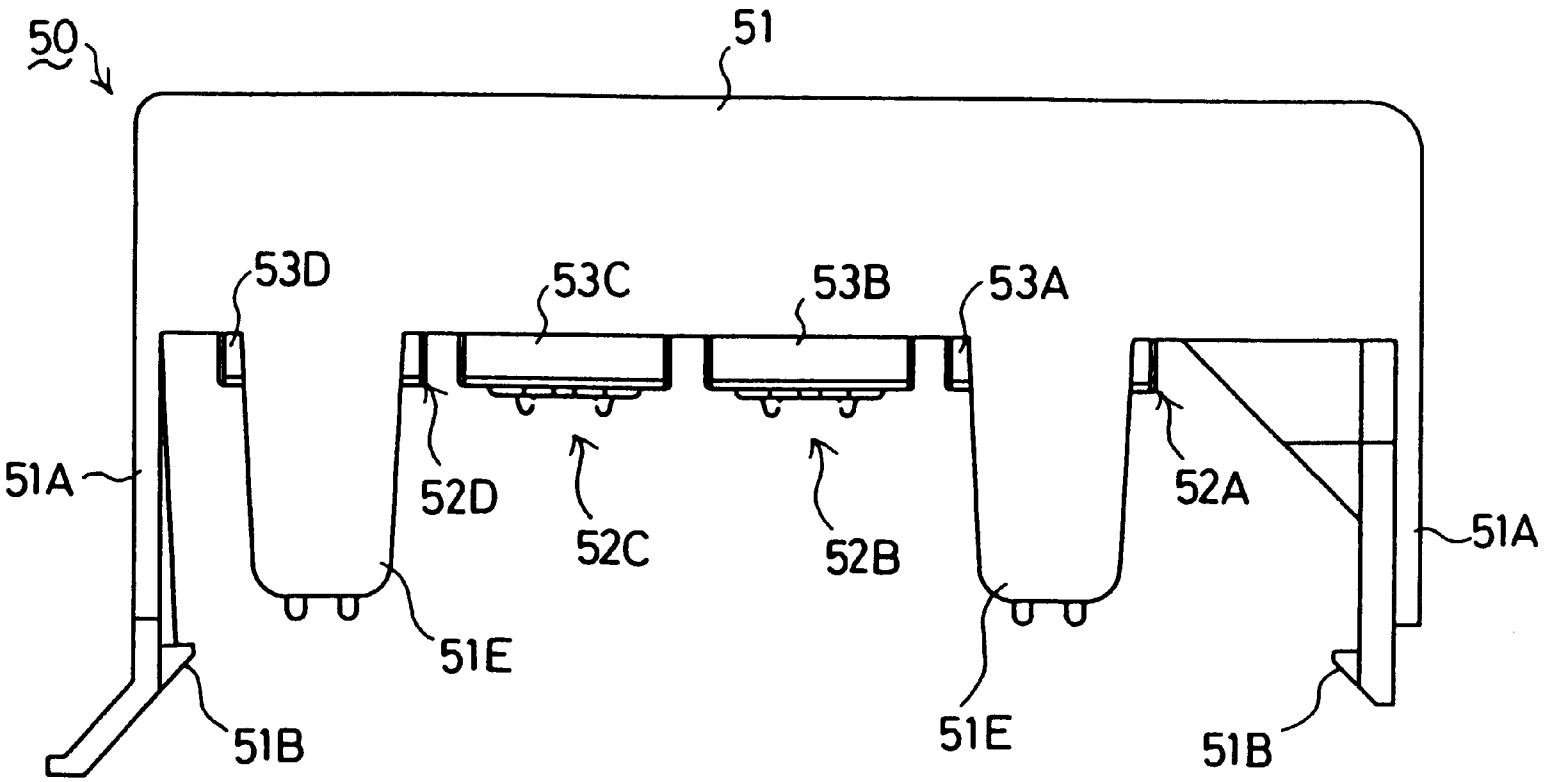
FIG. 9 is a top view of a capping device of a second embodiment.
Figure 10:
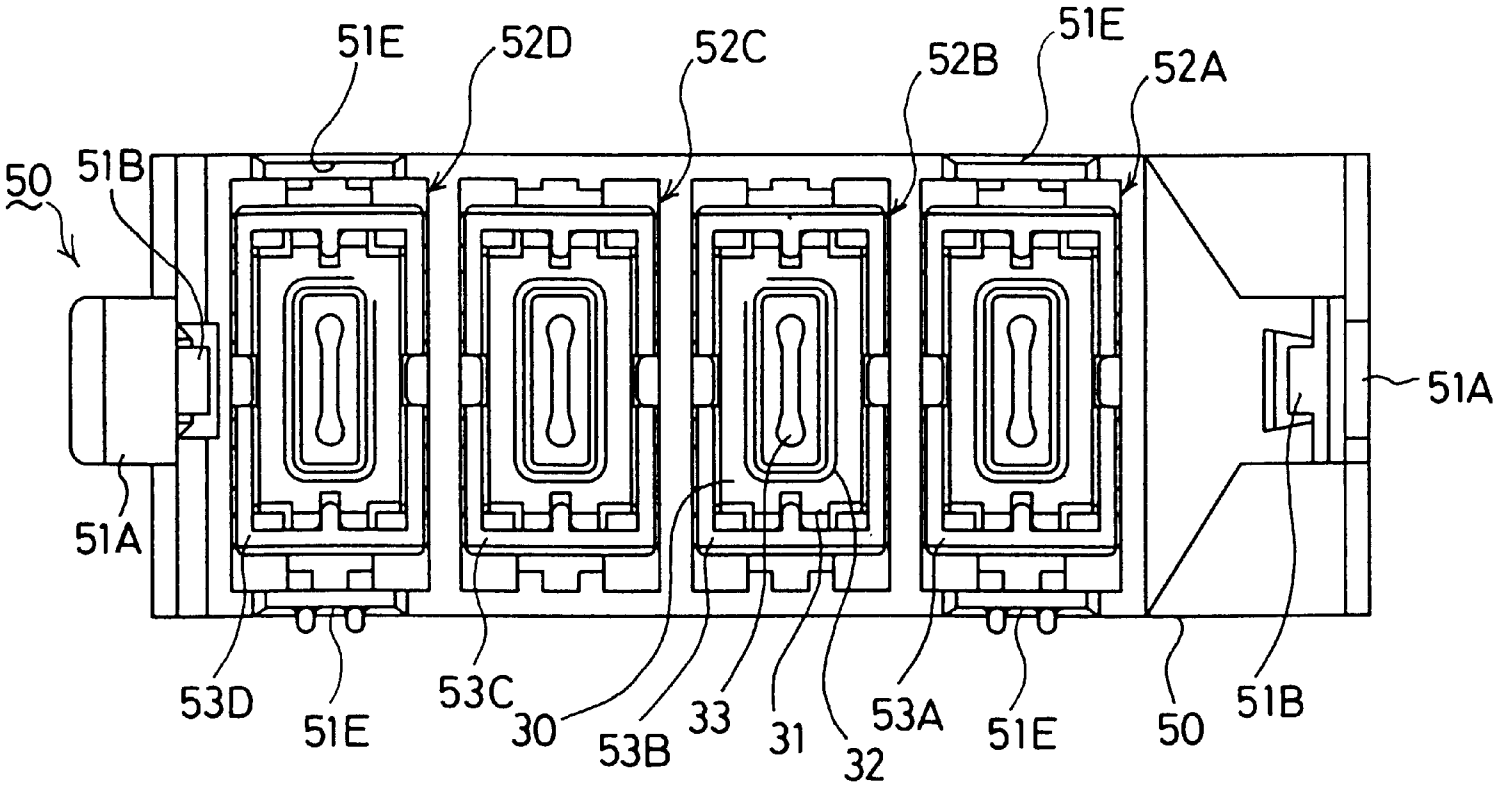
FIG. 10 is a front view of a capping device of the second embodiment.
Figure 11:
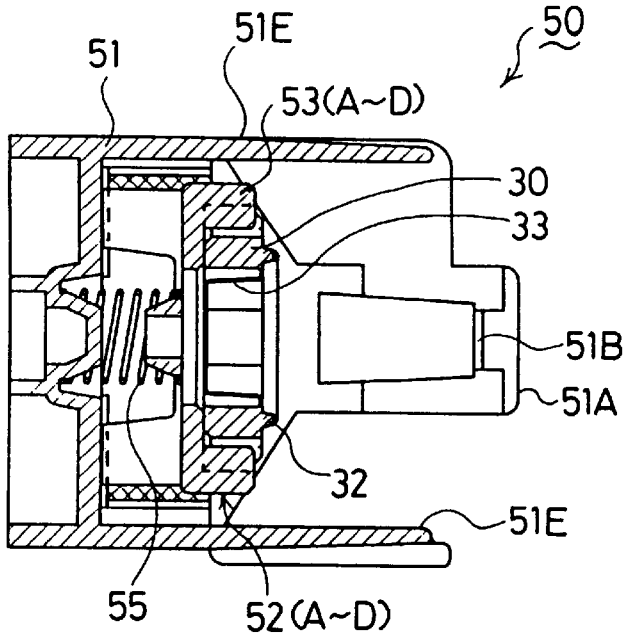
FIG. 11 is a side sectional view of the capping device of the second embodiment.

Next, the capping device of the second embodiment will be explained. The capping device 50 is designed to be installed to the printer 1, and may be prepared as a capping device to be attached to a head unit of a print head to be stored or shipped separately from the printer 1. The capping device 50 is shown in FIGS. 9 to 11. FIG. 9 is a top view, FIG. 10 is a front view, and FIG. 11 is a side sectional view of the capping device. The capping device 50 is prepared separately from the printer 1, to be attached to the print head 2 side of the head unit to protect the nozzle surface of the print head 2 when the head unit, before installation to the printer 1 is, for instance, shipped from a manufacturing factory, and is to be removed when the head unit is installed on the printer 1. The capping device 50 serves to cover a plurality of print heads 2 of the head unit and comprises a cover case (connecting section or housing) 51 for connection to the head unit, and caps 52A–52D corresponding to the plurality of print heads 2 and comprising the same as the aforementioned caps 16A–16D. In this example there are four print heads 2 with a corresponding four caps 52A–52D. However, the number of caps 52 will equal the number of print heads 2.

The cover case 51 has arms 51A on both sides. Inside the forward end of the arm 51A there is provided a projecting portion 51B for engagement with the head holder 4. The caps 52A–52D have a base section 30, a projecting section 31, a contact section 32, and a deforming diaphragm (deforming section) 33. The base section 30, etc. are attached to bases, or frames, 53A–53D. The bases, or frames, 53A–53D are attached to a cover case 51 by springs (elastic members) 55 in such a manner that they are movable in a direction intersecting at right angles with the arrangement surface of the bases 53A–53D. Since each of the caps 52A–52D is attached to the cover case 51 by a spring 55, each nozzle of the print head 2 can be covered at the same pressure with the caps 52A–52D. Furthermore, because each of the caps 52A–52D is fitted with a spring 55, the caps can uniformly attached to the nozzles, and therefore it is possible to reliably enclose all the nozzles of the print head. The method of supporting the caps 52A–52D by the springs 55 is applicable also to the cap mechanism in the printer. For the caps 52A–52D and the housing of the springs 55, common parts are usable in the cap mechanism in the printer.

Figure 12:
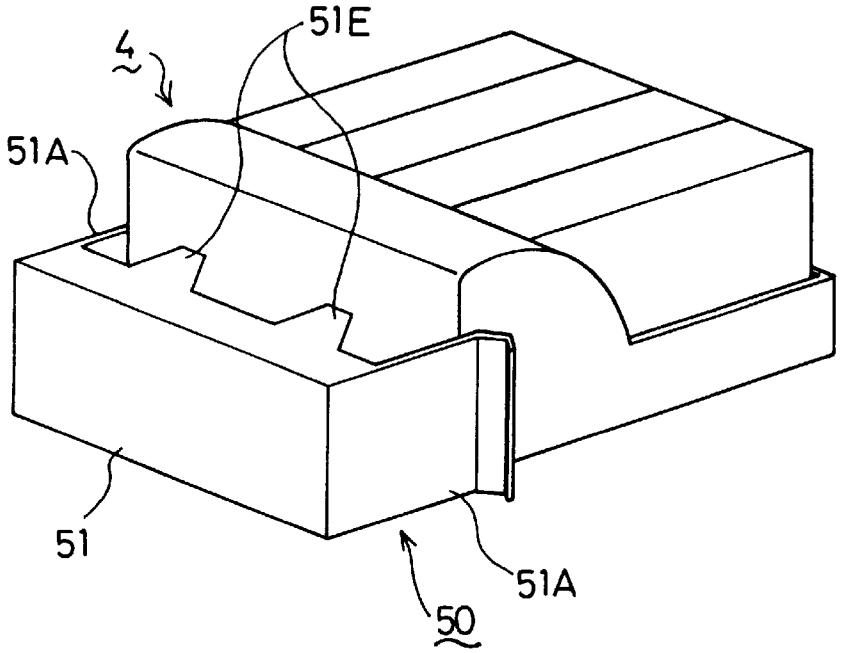
FIG. 12 is a perspective view showing the capping device of the second embodiment mounted on a head unit.
Figure 13:
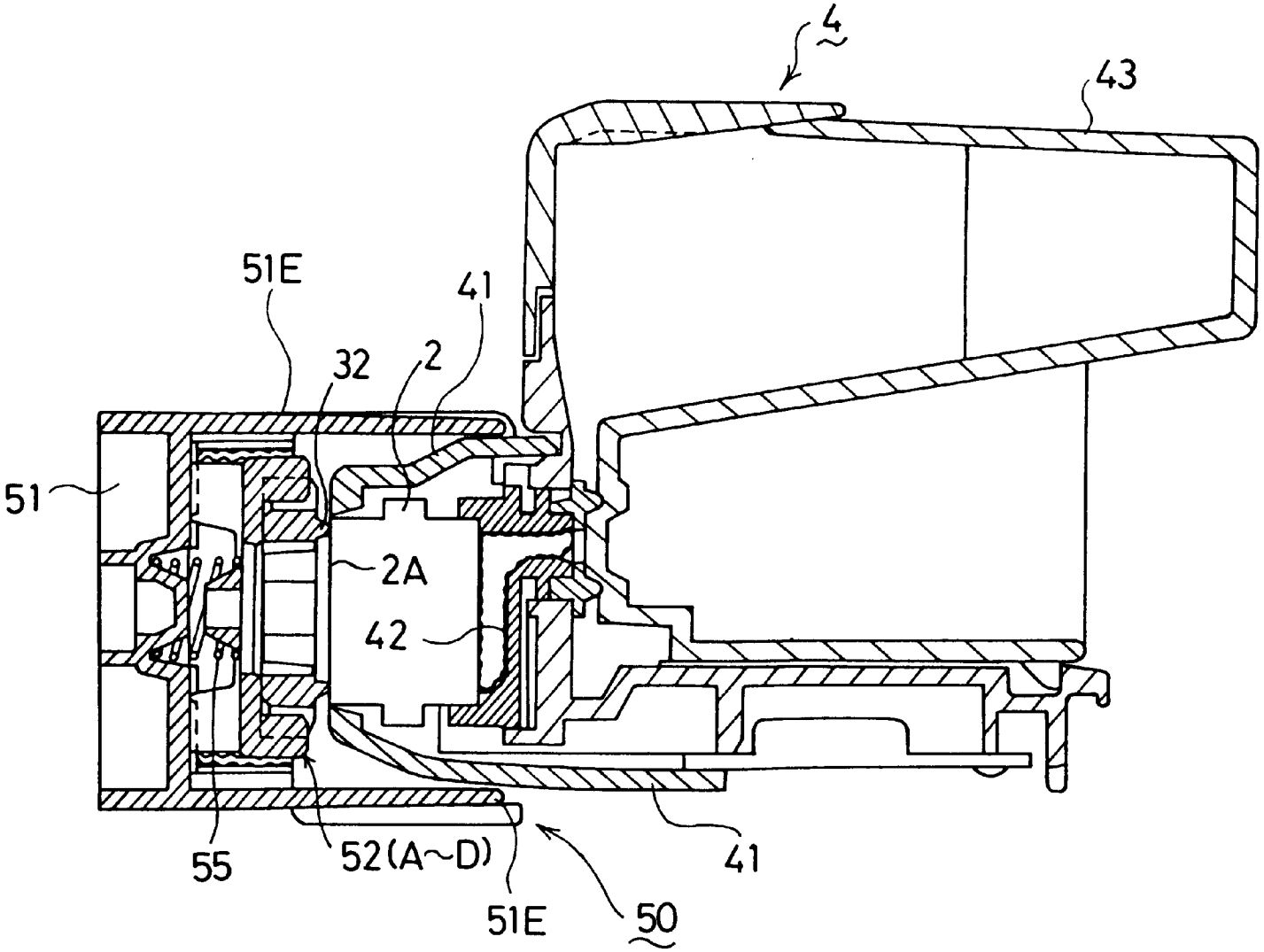
FIG. 13 is a side sectional view showing the capping device of the second embodiment mounted on the head unit.

FIG. 12 is a perspective view showing the capping device 50 mounted to the head holder 4 and FIG. 13 is a side sectional view of the same. The capping device 50, when mounted to the head holder 4, is pressed against the print head 2 while holding both sides of the head holder 4 with the arms 51A, the projecting portion 51B associated with each arm 51A is elastically engaged with a recess section provided in the side surface of the head holder 4. When the capping device 50 is attached to the head holder 4, the nozzle row of each print head 2 is covered with the capping device 50 and each nozzle array of the print head 2 is enclosed by one of the caps 52A–52D. Projecting portions 51E formed on the upper and lower sides of the cover case 51 fit on the upper and lower sides of the cover member 41 surrounding the print head 2, as shown in FIG. 13, when the capping device 50 is mounted to the head holder 4, thereby preventing vertical displacement of the capping device 50.

When the head unit is to be shipped from a manufacturing factory, as a separate unit, a preservative liquid is filled in the plurality of ink chambers in the print head 2 and into a manifold 42, for distributing the ink from the ink cartridge into the ink chambers. Then the front surface of the print head 2 and the nozzle surface 2A are enclosed by the capping device 50 as described above; and the rear end opening of the manifold 42 is closed by attaching a second capping member 43.

The use of the capping device 50 encloses each nozzle of the print head 2 to prevent the nozzles from drying at the time of shipment of the head unit from a manufacturing factory. Furthermore, a pressure difference between the interior of the print head 2 and the atmosphere which is caused by an outside pressure change or an internal pressure change resulting from evaporation of the preservative liquid contained in the ink chambers of the print head 2 and the manifold 42 is absorbed by the deforming diaphragm 3. Therefore, exposure of the interior of the print head 2 to the atmosphere resulting from the pressure difference can be prevented. Also, the capping device 50 can very easily be mounted simply by pushing both arms 51A along the side faces of the head unit 4. Thus mounting the capping device 50 caps all the nozzles of the four print heads 2 at the same time. The capping device, therefore, can be conveniently used.

The above-described capping device 50 is provided with four caps 52A–52D correspondingly to the four print heads 2. It, however, is to be noticed that the invention is not limited to the above structure. For instance, only a single cap may be provided for capping a nozzle of one print head. It is to be understood that the invention is not restricted to the particular forms shown in the foregoing embodiment. Various modifications and alterations can be made thereto without departing from the scope of the invention encompassed by the appended claims.

What is claimed is:

1. A capping device for capping nozzles of a nozzle array, comprising:

a contact section for contacting a portion surrounding the nozzle array; and a deforming section having an opening portion which opens toward the nozzle array, said deforming section for changing a shape of the opening portion to change a size of an enclosed space between said capping device and the nozzle array when said contact section is in a contact state with the nozzle, wherein said deforming section is provided with a bag-shaped section having a side wall extending from the opening portion in a direction away from the nozzle array, the opening portion having a longer contour than a contour of a minimum length surrounding the opening portion and at least a part of the side wall of said bag-shaped section can move inwardly and outwardly of the bag-shaped section to change the size of the enclosed space between the capping device and the nozzle.

2. The print head capping device according to claim 1, wherein said deforming section is deformable to keep a pressure in the enclosed space lower than a meniscus breaking pressure of a meniscus formed in the nozzle when said contact section is in a contact state with the nozzle.

3. The print head capping device according to claim 1, further comprising a flange section between the opening portion and said contact section.

4. The print head capping device according to claim 1, wherein the opening portion has a truncated tear shaped section at each end of the opening portion and a straight section connecting the truncated tear shaped sections.

5. The print head capping device according to claim 1, wherein said bag-shaped section has a contracted space nearly at the center of a pair of side walls and a wide space at both ends of the pair of side walls.

6. A print head capping device for protecting a nozzle face of each print head of a head unit having a plurality of print heads, for hermetically capping each nozzle, comprising:

a connecting section for connecting said capping device to said head unit;

a plurality of frames, one for each print head, mounted to the connecting section;

a cap member supported in each frame, the cap member comprised of an elastic member, the cap member tightly contacting a periphery of the print head nozzle face with a constant pressure, wherein each cap member comprises:

a base section of substantially rectangular structure;

a flange extending across one side of the base section;

a contact section extending from the flange in a direction opposite to the base section; and a deforming bag formed in the flange extending between the substantially rectangular structure of the base and having an opening opposite the nozzle array, and the contact section encloses the nozzle array when in contact with the nozzle face, the deforming bag having a bottom opposite the opening; and a wall extending between the opening in the flange and the bottom, the wall having, when viewed in plan, a truncated tear shaped section at each end of the opening and a straight section with parallel walls connecting the truncated tear shaped end sections, at least a part of the wall of said deforming bag can move inwardly and outwardly of the bag-shaped section to change the size of the enclosed space between the capping device and the nozzle.

7. The print head capping device according to claim 6, wherein an interior of said print head is filled with a preservative liquid.

8. The print head capping device according to claim 6, further comprising a plurality of springs, a spring between each frame and the connecting member.

9. A protective capping device for a print unit of a printing apparatus, the print unit having at least one print head, the print head having a nozzle face with a nozzle array, comprising:

a frame for each print head;

a cap, mounted to each frame, having;

a base section of substantially rectangular structure;

a flange extending across one side of the base section;

a contact section extending from the flange in a direction opposite to the base section; and a deforming bag formed in the flange extending between the substantially rectangular structure of the base and having an opening opposite the nozzle array, wherein the contact section encloses the nozzle array when in contact with the nozzle face, the deforming bag having a side wall extending from the opening in a direction away from the nozzle array, the opening having a longer contour than a contour of a minimum length surrounding the opening and at least a part of the side wall of the deforming bag can move inwardly and outwardly of the deforming bag to change the size of the enclosed space between the capping device and the nozzle.

10. The protective capping device according to claim 9, wherein the deforming bag has:

a bottom opposite the opening; and a wall extending between the opening in the flange and the bottom, the wall having, when viewed in plan, a truncated tear shaped section at each end of the opening and a straight section with parallel walls connecting the truncated tear shaped end sections.

11. The protection capping device according to claim 9, wherein the base section, the flange, the contact section, and the deforming bag are formed as one piece.

12. The protective capping device according to claim 9, further comprising a housing for receiving each frame; and a spring between the housing and each frame.

13. The protective capping device according to claim 12, wherein the housing has at least one pair of opposing projections, a projecting extending from opposing sides of the housing to engage the print unit and hold the protective capping device thereon.

14. The protecting capping device according to claim 12, wherein the housing is mounted in the printing apparatus to oppose the print unit at a non-print position.

15. The protective capping device according to claim 9, wherein the base section has means for attaching the cap to the frame.

16. A capping device for a print head having a nozzle array, comprising:

a contact section for contacting a periphery portion of the nozzle array, the contact section forming an enclosed space between the print head and the capping device when in contact with the periphery portion of the nozzle; and a deforming section formed integrally with the contact section, the deforming section for absorbing a pressure change within the enclosed space, wherein the deforming section has:

an opening;

a bottom opposite the opening; and a wall extending between the opening and the bottom, the wall having, when viewed in plan, a truncated tear shaped section at each end of the opening and a straight section with parallel walls connecting the truncated tear shaped end sections, at least a part of the wall of the deforming section can move inwardly and outwardly of the deforming section to change the size of an enclosed space between the capping device and the nozzle.

17. The capping device according to claim 16, further comprising:

a frame for receiving the contact section;

a housing for receiving the frame; and a spring between the housing and the frame.

* * * * *